US007296772B2

(12) United States Patent
Wang

(10) Patent No.: US 7,296,772 B2
(45) Date of Patent: Nov. 20, 2007

(54) HANGTAG FOR PLASTER TROWEL

(76) Inventor: See-Tuh Wang, No. 14, Jhenping St., Fusing Township, Changhua County (TW)

( * ) Notice: Subject to any disclaimer, the term of this patent is extended or adjusted under 35 U.S.C. 154(b) by 37 days.

(21) Appl. No.: 11/103,855

(22) Filed: Apr. 12, 2005

(65) Prior Publication Data

US 2005/0224673 A1 Oct. 13, 2005

(30) Foreign Application Priority Data

Apr. 12, 2004 (TW) ..... 93205571 U

(51) Int. Cl.
*A47F 5/00* (2006.01)

(52) U.S. Cl. ..... 248/309.1; 211/70.6; 206/349; 248/113; 248/339

(58) Field of Classification Search ..... 248/309.1, 248/317, 339, 689, 113; 206/349, 378, 1.5; 211/70.6
See application file for complete search history.

(56) References Cited

U.S. PATENT DOCUMENTS 5,906,350 A * 5/1999 Kao ..... 248/688
6,076,669 A * 6/2000 Ling ..... 206/349
6,193,200 B1 * 2/2001 Kao ..... 248/309.1
6,637,591 B2 * 10/2003 Chen ..... 206/349
6,672,555 B2 * 1/2004 Chang ..... 248/317
6,679,379 B1 * 1/2004 Kao ..... 206/349
2004/0256530 A1 * 12/2004 Wheeler et al. ..... 248/317
2006/0086636 A1 * 4/2006 Kuo ..... 206/495

* cited by examiner

*Primary Examiner*—Ramon O Ramirez
(74) *Attorney, Agent, or Firm*—Egbert Law Offices

(57) ABSTRACT

A special hangtag for plaster trowel, which is in flat shape, has a hanging hole on top. The limit section of the grip is placed in the middle of the hangtag, which can be lifted up forward, and the structure is designed to place the grip of the plaster trowel. On one side of the hole for supporting rod is a guiding slot coming from one side of the hangtag, which makes the supporting rod that is located between the grip and the low profile of the plaster trowel to be located in the hole for supporting rod from the guiding slot. Thus, the grip of the plaster trowel and the supporting rod are horizontally and vertically supported by the limit section of the grip and the hole for supporting rod, and forms a one-unit position with hangtag.

4 Claims, 7 Drawing Sheets

HANGTAG FOR PLASTER TROWEL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a hangtag, and more particularly to a hangtag that is specially designed for plaster trowel.

BACKGROUND OF THE INVENTION

Many products sold in the market today rely on the hangtag for display and management. Moreover, this type of hangtag is widely used with all kinds of hand tools and the products with related components, and the structure varies depending on the shape and feature of the product that is placed upon it. For instance, some hangtags are made with the combination of blister and paperboard with the product placed in it; some hangtags have holders for the handles of hand tools to clip. Even though there are many types of hangtags, however, there are many types of products as well, some of the products are still used without the design of the hangtags, for instance, the common hand tools like plaster trowel used in the construction is one of them. Because its unique appearance, it is still being displayed by placing it on the shelf, which is hard to get a better display effect and the best availability for space.

Thus, to overcome the aforementioned problems of the prior art, it would be an advancement if the art to provide an improved hangtag structure that is used specially for the product with special shapes that can significantly improve the efficacy.

BRIEF SUMMARY OF THE INVENTION

The effects of the present invention are as follows:

1. Providing a hangtag that has limit section of the grip in the middle of the hangtag, and a hole for supporting rod is created on the bottom of the hangtag for the plaster trowel. This hangtag is indeed the first seen in the industry that meets the requirement for new patent.

2. To assemble the plaster trowel 20 with the hangtag 10, first force the supporting rod 23 of the plaster trowel 20 to go in the hole for the supporting rod 13 through the guiding slot 14, and then lift up the limit section 12 of the grip of the plaster trowel to complete the assembling. To disassemble it, just do it backwards, therefore, it is easy and convenient to assemble as well as disassemble the unit.

The new effects of the present invention:

1. This hangtag 10 and plaster trowel 20 would still be in original condition, and the user can use the hangtag 10 to store the plaster trowel 20 when not using it. This advantage is obviously more advanced than the known blister hangtag.

A through slot 15 is created on the hangtag 10, so that when the limit section 12 of the grip of the U-shaped holder is restored, it would be back in the through hole 15, and the hangtag 10 would in the flat position. By doing so, not only it can save its volume, but also save more storage space for the industry.

2. The through slot 15 is created on the hangtag 10, so that when the limit section 12 of the grip of the U-shaped holder is restored, it would be back in its structure, and the hangtag 10 would be in a flat position when not being used. By doing so, not only it can save its volume, but also save more storage space for the industry.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
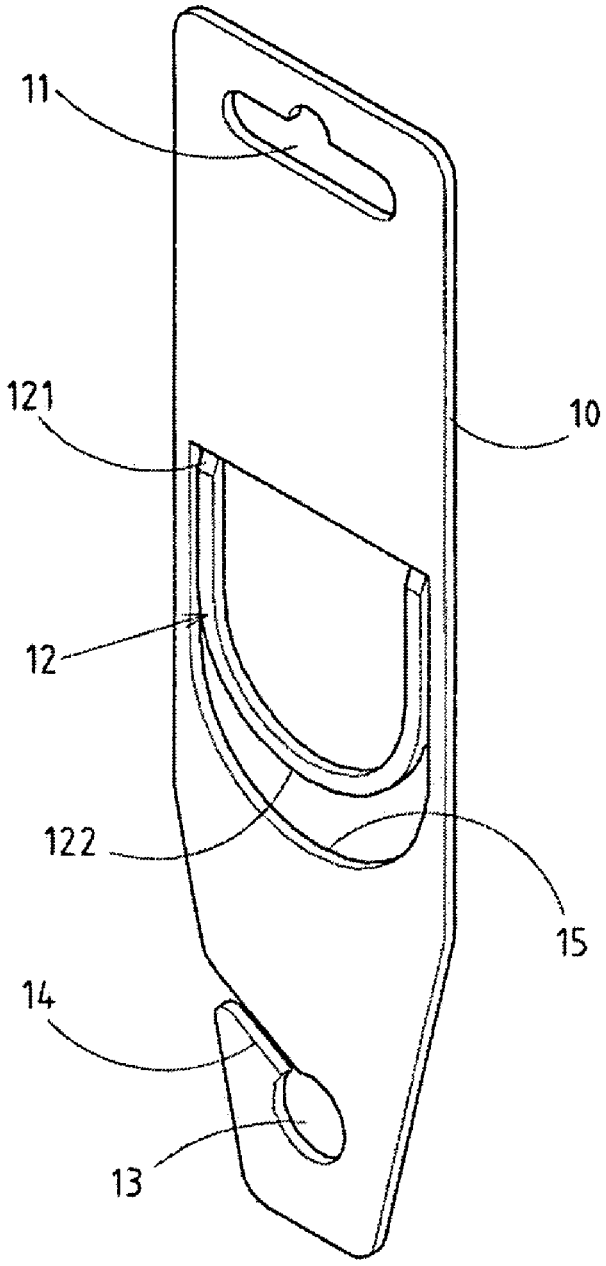
FIG. 1 shows a perspective view of the hangtag in the first state.
Figure 2:
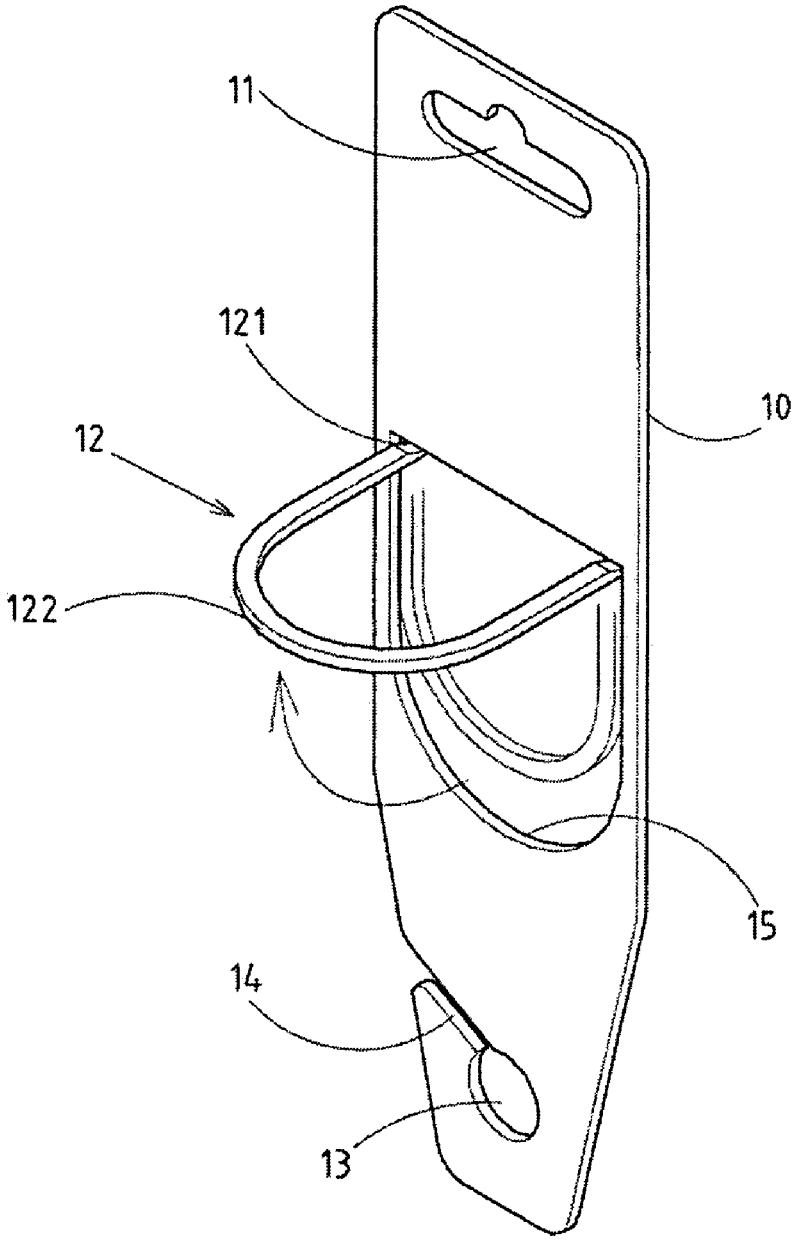
FIG. 2 shows a perspective view of the hangtag in the second state.
Figure 3:
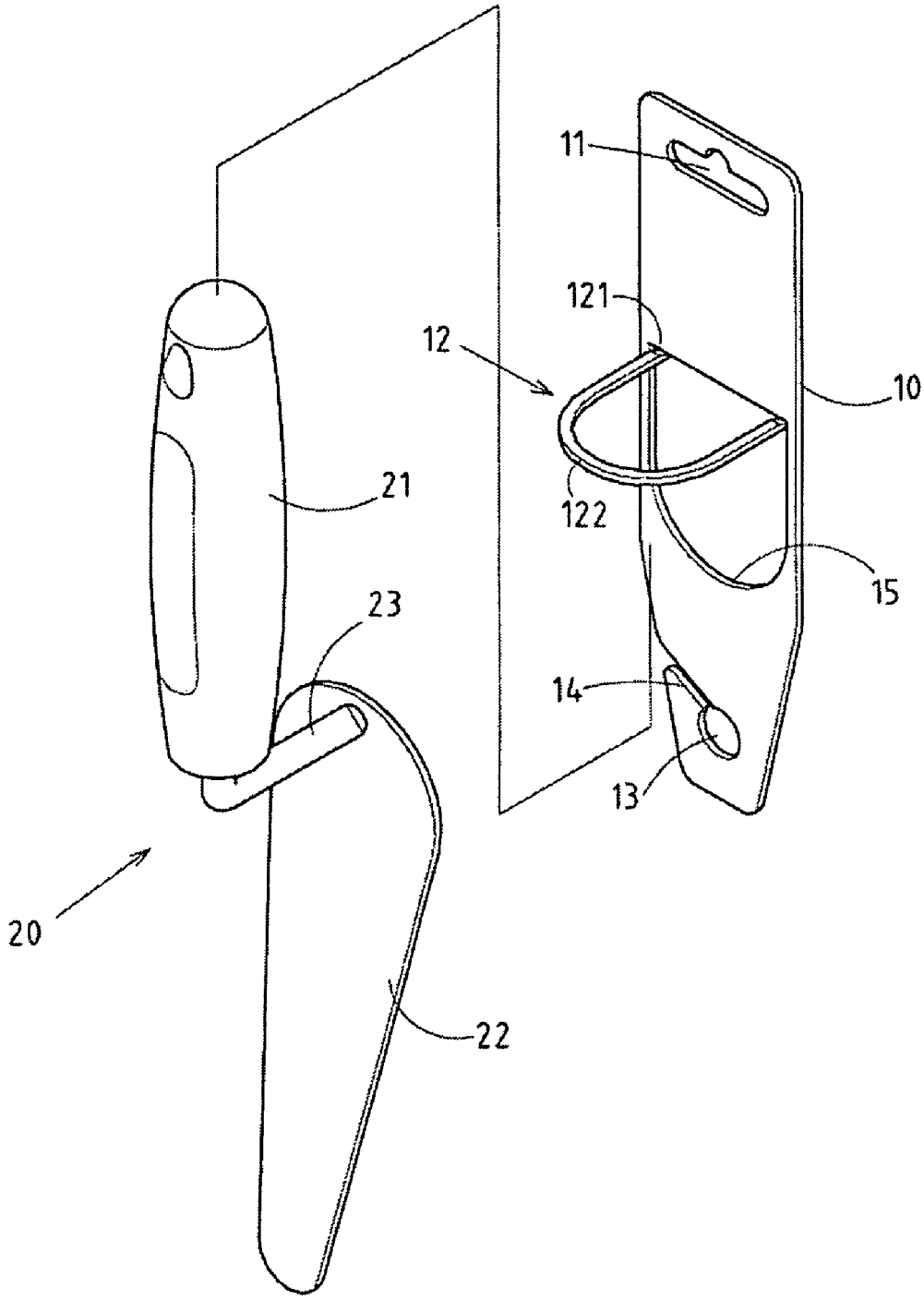
FIG. 3 shows a perspective view of the hangtag and plaster trowel in an unassembled state.
Figure 4:
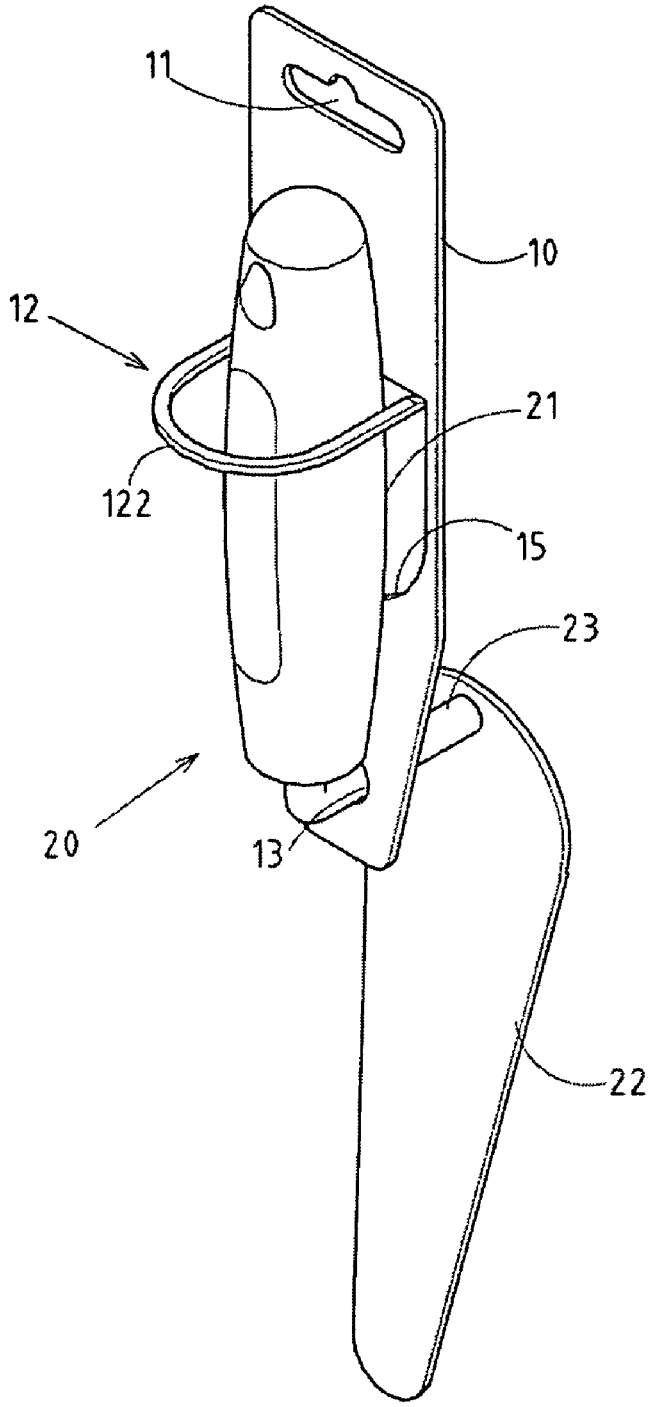
FIG. 4 shows a perspective view of the hangtag and plaster trowel in an assembled state.

As shown in FIG. 1, there is a hangtag for plaster trowel embodied in the present invention.

The invention includes a hangtag 10, which is in flat shape, has a hanging hole 11 on the top, which can be hung on the hook in the market.

The limit section of the grip 12 that can be lifted up is placed in the middle of the hangtag 10, and the shape of this limit section of the grip is made for the grip 21 of the plaster trowel. There is hole for supporting rod 13 placed between the bottom of hangtag 10 and the limit section 12 of the grip, and on one side of this hole for supporting rod 13 is a guiding slot 14 coming from one side of the hangtag 10, which makes the supporting rod 23 that is located between the grip 21 and the low profile 22 of the plaster trowel to be placed in the hole for the supporting rod 13 from the guiding slot 14.

Thus, the grip 21 of the plaster trowel 20 and the supporting rod 23 are placed horizontally and vertically with the limitation from the limit section 12 of the grip and the hole for supporting rod 13, and forms a unit position with hangtag 10.

The limit section 12 of the grip is a U-shaped holder that is attached to the hangtag 10 by the thin film 121 on both ends, and the surrounding frame 122 of this U-shaped holder can be lifted up easily. A through slot 15 is created on the hangtag 10 that when the limit section 12 of the grip of the U-shaped holder is restored, it would be back in the through hole 15, and the hangtag 10 would be in the flat position. By doing so, not only it can save its volume, but also save more storage space for the industry.

The width of the guiding slot 14 of the supporting hole 13 is smaller than the supporting rod 23 of the plaster trowel 20, and the direction of the guiding slot 14 is going up to one side of hangtag in an angle, therefore, the supporting rod 23 of the plaster trowel 20 must be forced to go through the guiding slot 14, so when the supporting rod 23 is clipped in the supporting rod hole 13, it can not be pushed out from the guiding slot 14 easily, which is in a secure position.

Through the above structure and design, the operation of the assembling and disassembling of the unit disclosed by the present is explained as follows:

To assemble the plaster trowel 20 with the hangtag 10, first force the supporting rod 23 of the plaster trowel 20 to go in the supporting rod hole 13 through the guiding slot 14, then lift up the surrounding frame 122 of the limit section 12 of the grip and place the grip 21 of the plaster trowel 20 inside the frame limitation, this way, the plaster trowel 20 receives the restrictive effect horizontally and vertically, and it is combined with the hangtag 10 in one. Moreover, when the user buys the plaster trowel 20, all he needs to do is lifting up the surrounding frame 122 of the limit section 12 of the grip to move the grip 21 of the plaster trowel 20 off the fixed position, and forces the supporting rod 23 out from the hole for the supporting rod 13 through the guiding slot 14. By doing so, separate the plaster trowel 20 and the hangtag 10 easily and quickly, and the hangtag 10 would still be in original condition, and the user can use the hangtag 10 to store the plaster trowel 20 when not using it. This advantage is obviously more advanced than the known blister hangtag.

Figure 5:
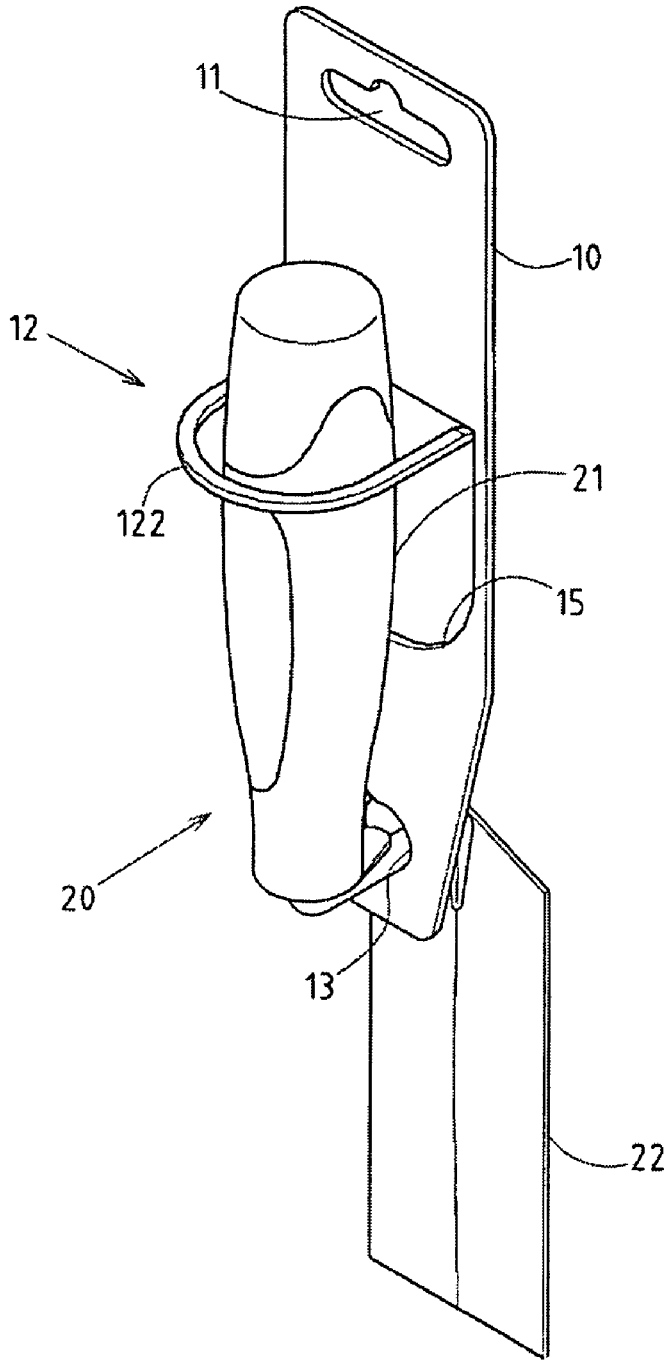
FIG. 5 shows another perspective view of the hangtag assembled onto the trowel.

As shown in FIG. 5, a three dimensional figure of the hangtag 10 of this invention combined with the plaster trowel 20.

Figure 6:
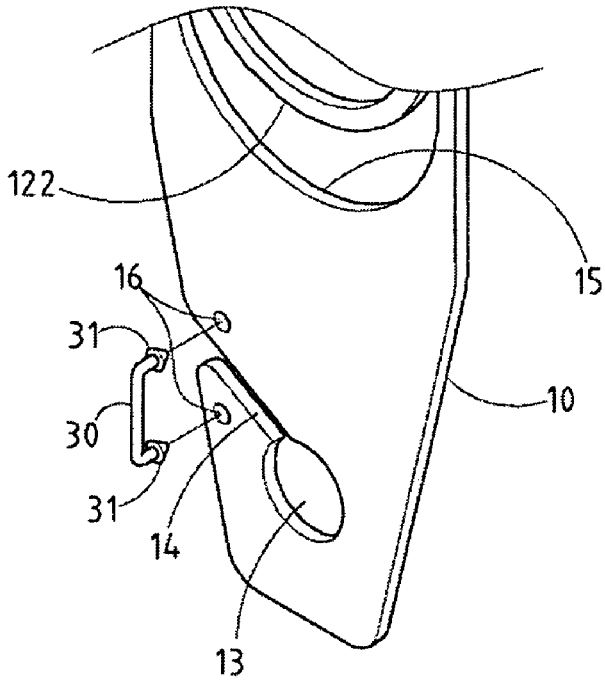
FIGS. 6-9 show partial perspective views of the embodiments of the supporting rod of the hangtag in the guiding slot to form the limit section.

The location of the guiding slot 14 of this supporting rod hole 13 has the stopper that can block that guiding slot 14 (see later part for detail). By adding this stopper, it would help the plaster trowel 20 from coming loose (from the hangtag 10) after it is put up, this way, it can secure the plaster trowel in this position when it is being displayed in the market, and it would not be easily stolen by thieves. There are also several styles of that stopper, the examples are described as follows:

As shown in FIG. 6, through holes 16 can be made from both sides of guiding slot 14 as well as a U-shaped locating pin 30, and set the snap 31 on both ends, and clip it to the through holes 16 mentioned above to block the guiding slot 14.

Figure 7:
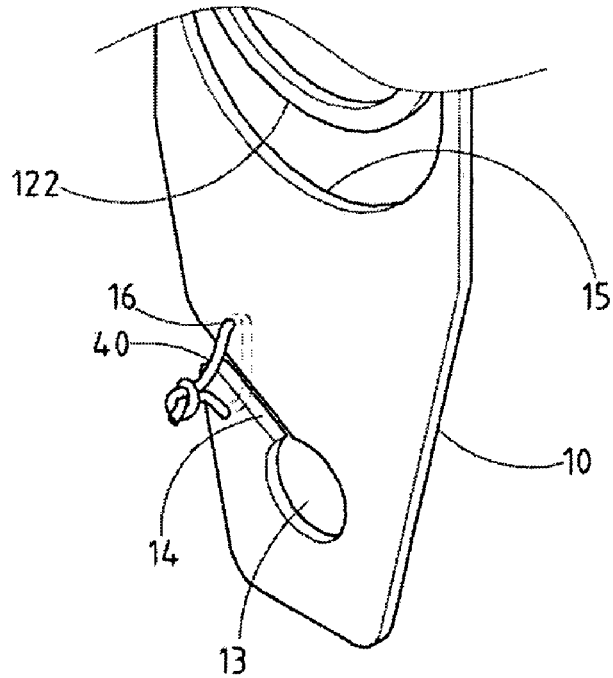

As shown in FIG. 7, same through holes 16 can be made from both sides of guiding slot 14 to block the guiding slot 14 through stringing 40.

Figure 8:
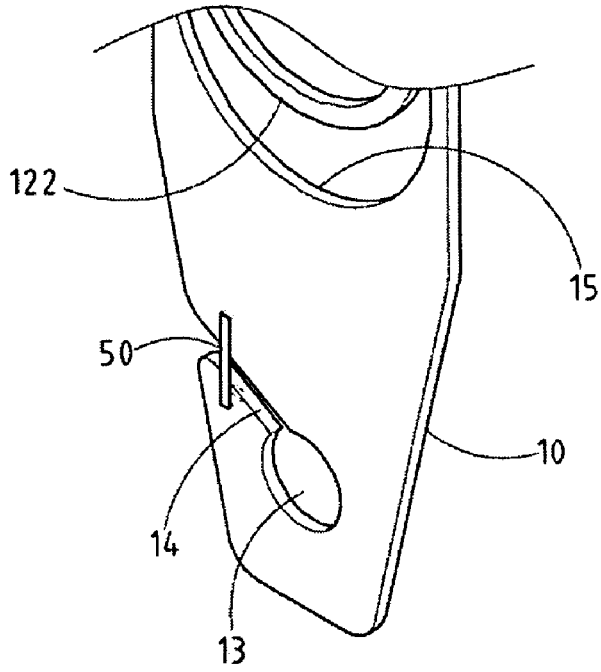

As shown in FIG. 8, staple 50 the opening the guiding slot 14 to block the guiding slot 14.

Figure 9:
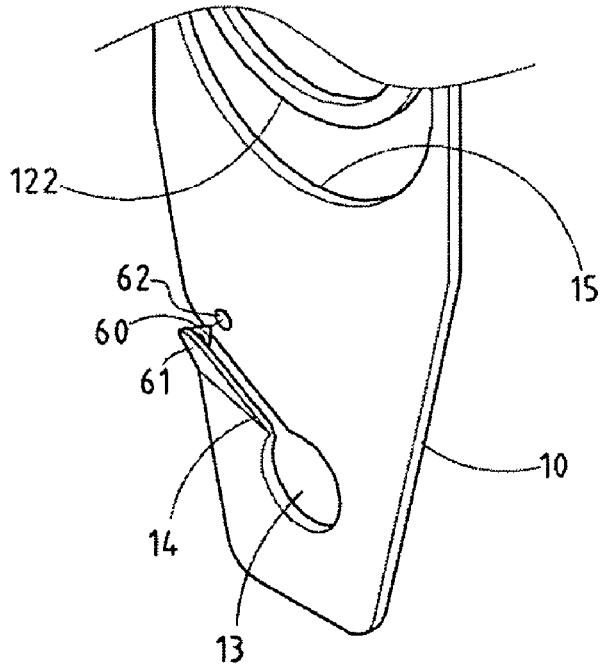

As shown in FIG. 9, placing removable panel 61 that has clip bolt 60 on one side of the guiding slot 14, and make a clip hole 62 on the other side of the guiding slot 14, by doing so, the clip bolt 60 is clipped to the clip hole 62, so that the removable panel 61 blocks the guiding slot 14.

I claim:

1. An article for receiving a handle of a plastic trowel, the handle having a supporting rod extending therefrom, the article comprising:

a hangtag having a flat shape;

a first hole formed at a top of said hangtag;

a grip positioned in a middle of said hangtag, said grip movable upwardly and forwardly such that an interior of said grip can receive the handle of the plastic trowel therein; and a second hole formed on said hangtag between a bottom of said hangtag and said grip, said second hole suitable for receiving the supporting rod therein, said second hole having a guiding slot extending to one side of said hangtag, said guiding slot allowing the supporting rod to pass therethrough and into said second hole.

2. The article of claim 1, said grip having a U-shape in which a pair of legs of said U-shape have respective ends that are flexibly affixed to said hangtag, said hangtag having a slotted area formed in a surface thereof, said grip received within said slotted area.

3. The article of claim 1, said guiding slot having a width dimension that is less than a diameter dimension of the supporting rod, said guiding slot extending angularly upwardly toward said one said of said hangtag.

4. The article of claim 1, further comprising:

a stop affixed to said hangtag and extending across said guiding slot.

* * * * *